United States Patent [19]

Van Steenhoven et al.

[11] 3,983,387

[45] Sept. 28, 1976

[54] CONCEALED, SPRING-LOADED, SLIDE HINGE FOR LUMINAIRE DOOR

[75] Inventors: Frank Van Steenhoven, Peninsula; Adolf Meeuwen, Kent, both of Ohio

[73] Assignee: Westinghouse Electric Corporation, Pittsburgh, Pa.

[22] Filed: June 10, 1975

[21] Appl. No.: 585,734

[52] U.S. Cl. ..... 240/147; 240/51.11 R; 240/146

[51] Int. Cl.[2] ..... F21V 17/00

[58] Field of Search ..... 240/51.11, 146, 147; 16/179, 190

[56] References Cited

UNITED STATES PATENTS

| | | | |
|---|---|---|---|
| 2,701,840 | 2/1955 | Carlson | 240/147 |
| 3,142,447 | 7/1964 | Bodian | 240/147 |
| 3,315,074 | 4/1967 | Buzan et al. | 240/147 |
| 3,380,770 | 4/1968 | Risley | 240/147 |
| 3,643,291 | 2/1972 | Clark | 16/190 |

*Primary Examiner*—Russell E. Adams, Jr.
*Attorney, Agent, or Firm*—B. R. Studebaker

[57] ABSTRACT

A concealed, spring-loaded, slide hinge for mounting the light transmitting door to a luminaire housing. The slide hinge includes a hinge-slide member on each side of the door frame adjacent one end of the door and a hinge arm mounted on each of the slide members for sliding movement with respect thereto. A coil spring interconnects the hinge arm to the adjacent door frame end and urges the arm toward that end. Each hinge arm also carries a hinge pin thereon which pivotally mounts the slide hinge to the housing. When the door is opened, the spring urges the door away from the housing to permit the door to swing freely about the bottom edge of the housing while the pivotal connection is maintained.

7 Claims, 6 Drawing Figures

CONCEALED, SPRING-LOADED, SLIDE HINGE FOR LUMINAIRE DOOR

BACKGROUND OF THE INVENTION

This invention pertains to hinge mechanisms for mounting the light transmitting door to a luminaire housing and more particularly, to a spring loaded hinge mechanism for mounting a flat luminaire door to a rectangular luminaire housing.

For many years, interior lighting fixtures or luminaires have employed rectangular door frames for retaining the light transmitting refractor in order to close off the open bottom of the rectangular luminaire housing. In most instances, outdoor luminaires have had an ovate configuration and the hinge mechanisms for mounting the refractor retaining ring or door were either externally visible or the contour of the luminaire body permitted unimpeded swinging of the door member from a closed to an open position for purposes of relamping, etc. A close-fitting door frame was generally not a requirement for the commercial rectangular interior lighting fixture since in many instances space between the housing and the door was intentionally provided for either air return purposes or to provide a "picture frame" appearance to the planar exterior face of the luminaire. Outdoor lighting fixtures, on the other hand, have generally required that the luminaire door frame fit rather snugly with the luminaire housing since the outdoor fixture would be subjected to elements such as high winds, rain, snow, and flying dust and dirt particles, which preferably must be prevented from entering the interior of the luminaire.

With the advent of rectangular, square and box-like fixtures designed to complement modern building architecture, a need has arisen for a closure mechanism for these rectangular lighting fixtures which will permit the door of the luminaire to be open for purposes of relamping and cleaning and which also permit the door to either hang from the luminaire housing through a hinge connection or alternatively, be removed altogether from the housing with reasonable ease. It has been found that commercially available hinges for luminaire doors of the type employed in rectangular interior lighting fixtures, although providing the ability to be hinged to an open position or removed entirely, do not provide the kinds of sealed retention that is required for a luminaire which is intended for use out of doors and subject to the various weather conditions.

SUMMARY OF THE INVENTION

The foregoing problems described with respect to the adaptation of interior lighting fixture door frame hinges to rectangular outdoor luminaires are obviated by the concealed, spring-loaded, slide hinge mechanism of this invention. The foregoing is accomplished in accordance with the present invention by providing in a luminaire including a housing having side and end walls and a light transmitting door including a door frame contiguous with said side and end walls of the housing, an improved door mounting means comprising a pair of spaced hinge hooks on one side wall of the housing and a hidden hinge means on the door frame adjacent each of the hinge hooks for mounting the door to the housing. The hidden hinge means includes a pair of hinge slides mounted to the door frame sides, a hinge arm mounted to each of the hinge slides for relative sliding movement therebetween, and spring means interconnecting each of the hinge arms to the door frame and urging the hinge arms toward the side wall. A pivot pin is mounted on each of the hinge arms and is constructed and arranged to mount the hidden hinge means to the pair of spaced hinge hooks. Latch means are provided at the other end of the door frame for latching the door to the housing. When the door is opened, the spring means urges the door away from the housing to permit the door to swing freely about the bottom edge of the housing while the pivotal connection between the pivot pins and the spaced hinge hooks is retained.

BRIEF DESCRIPTION OF THE DRAWING

The principles of operation along with many of the attendant advantages of the present invention will become more readily apparent and better understood as the following detailed description is considered in connection with the accompanying drawings in which.

DESCRIPTION OF THE PREFERRED EMBODIMENT

Figure 1:
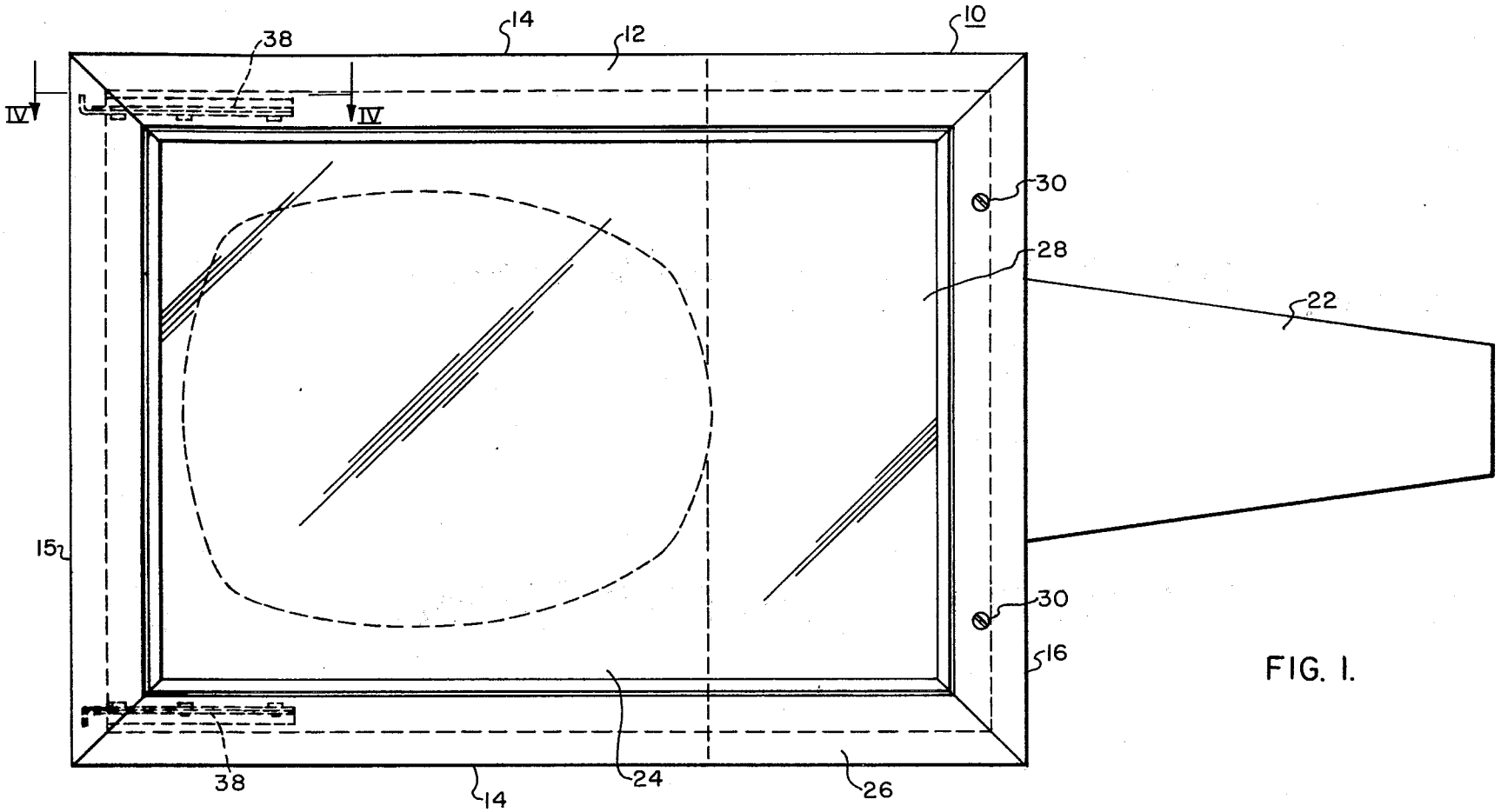
FIG. 1 is a bottom plan view of a rectangular outdoor luminaire employing the hinge mechanism of this invention.
Figure 2:
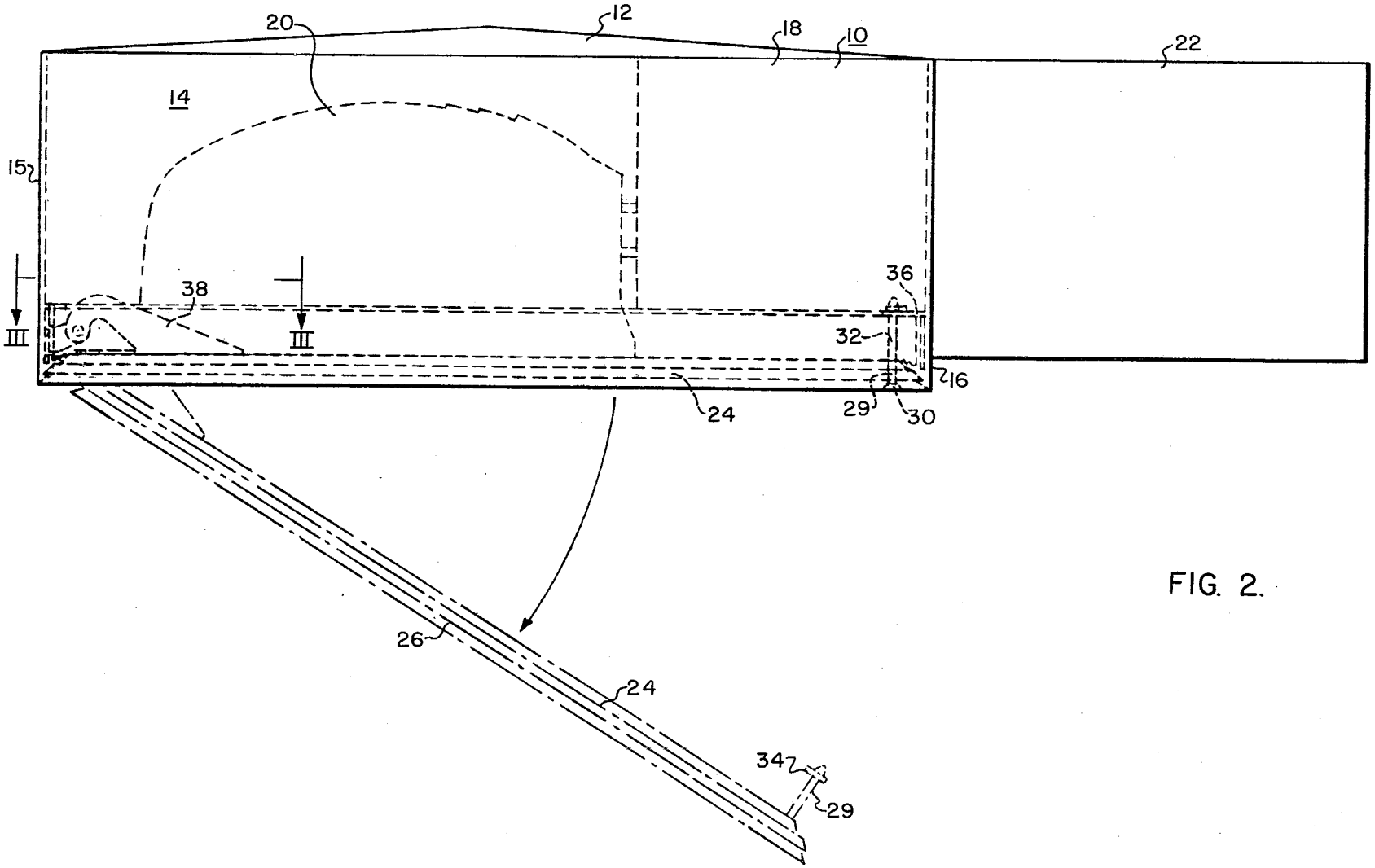
FIG. 2 is a side elevational view of the luminaire of FIG. 1 illustrating the luminaire door in a closed and partially open position.

Referring now in detail to the drawings wherein like reference characters represent like parts throughout the several views, there is illustrated in FIGS. 1 and 2 a typical rectangular outdoor luminaire generally designated 10. The luminaire generally includes a rectangular luminaire housing 12 having side walls 14 and end walls 15 and 16. Within the housing 12 is a ballast compartment 18 and a light compartment defined by the reflector 20. A mounting arm or shroud 22 is connected to the rearward end wall 16 of the luminaire housing 12 and serves to mount the luminaire to a pole or the like. The open bottomed housing 12 is closed off by a door 24 which includes a door fame 26 which is substantially contiguous with the side and end walls of the housing and supports a light transmitting panel 28 which may be in the form of clear glass, plastic, or may include light directing prisms if desired.

The luminaire door 24 is hinged to the front wall 15 in a manner to be later described with respect to the instant invention, and a pair of latches 29 are employed to secure the door at the opposite end of the luminaire housing.

Preferably, the latches are quarter turned screw-type latches 29 which include a screw head 30, a shaft 32 carrying a detent 34 which overlies a ledge 36 extending from the interior of the end wall 16 of the housing. Although the quarter turn screw-type latch is disclosed, it will be apparent that any type of latching mechanism could be employed in conjunction with the spring-loaded slide hinge of this invention.

Figure 3:
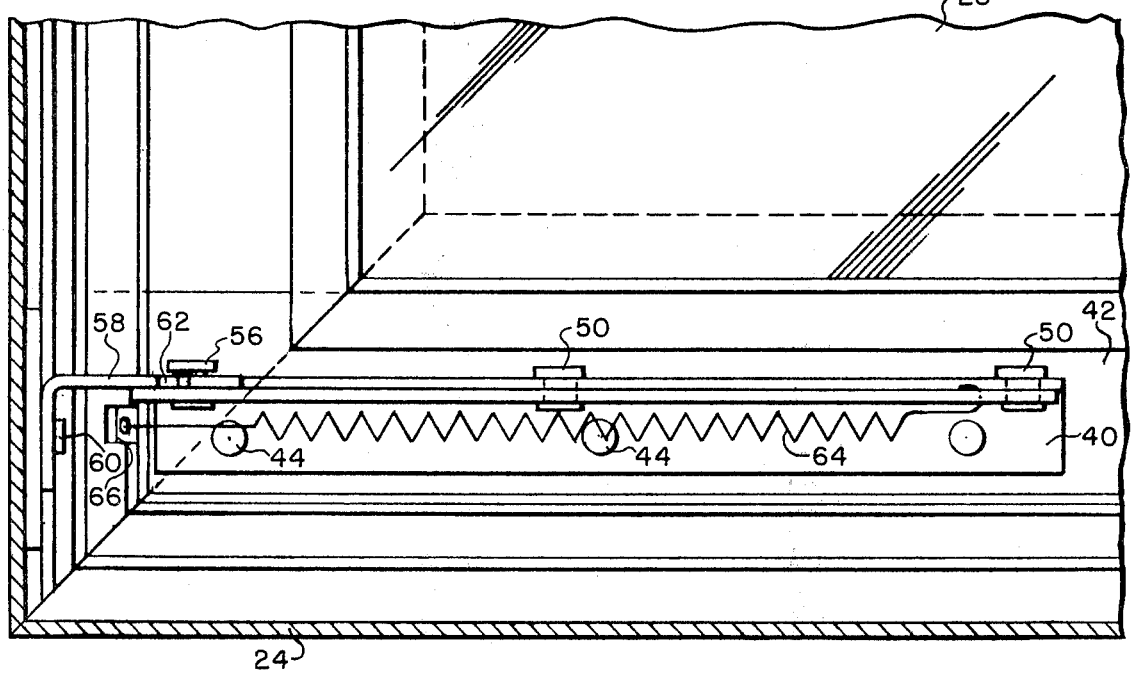
FIG. 3 is a sectional view of one corner of the luminaire taken along the line 3—3 of FIG. 2.
Figure 4:
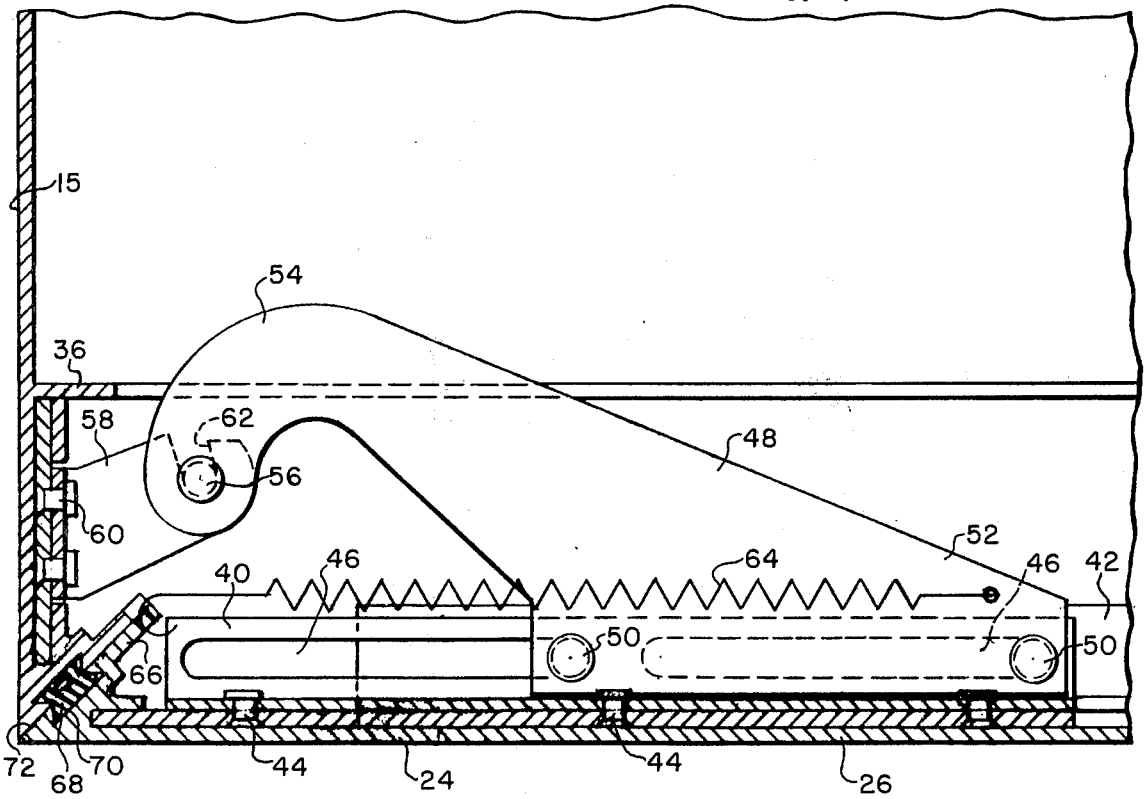
FIG. 4 is a partial sectional view taken along the line 4—4 of FIG. 1.

The spring-loaded slide hinge of this invention is illustrated in phantom at 38 in FIGS. 1 and 2, and may be seen in detail in FIGS. 3 and 4. As illustrated in FIGS. 3 and 4, the spring-loaded slide hinge of this invention includes a hinge slide 40 which is secured in a channel 42 in the door frame 26 by any suitable means such as, for example, rivets 44. The hinge slide includes a pair of spaced elongated slots 46 therein and the hinge arm 48 is mounted for slidable movement with respect to the hinge slide 40 by means of a pair of shoulder rivets 50 which extend respectively through the elongated apertures 46 in the hinge slide 40. The hinge arm includes a base end 52 to which the shoulder rivets 50 are secured and a neck end 54 which carries thereon a hinge pin 56 which extends at right angles to the plane of the hinge arm 48. A hinge hook 58 is mounted as, for example, by rivets 60 to the end wall 15 of the luminaire housing and includes therein a slot 62 in which the hinge pin 56 is retained.

A coil spring 64 is secured at one end to the base 52 of the hinge arm 48 and at its other end to a tab 66 on the end wall of the door frame 26. As will be apparent, the hinge spring 64 continuously urges the hinge arm 48 toward the left hand end of the elongated slots 46 in the hinge slide 40. When the door 24 is in its closed position, the interconnection of the hinge pin 56 in the hinge hook slot 62 prevents the hinge spring 64 from moving the hinge arm 48 toward the left hand side of the elongated slots 46 as illustrated in FIG. 4. When the door is in this closed position a sealing gasket 68 mounted in a slot 70 in the sloped edge 72 of the door frame edge provides a seal for the interior of the luminaire housing.

Figure 5:
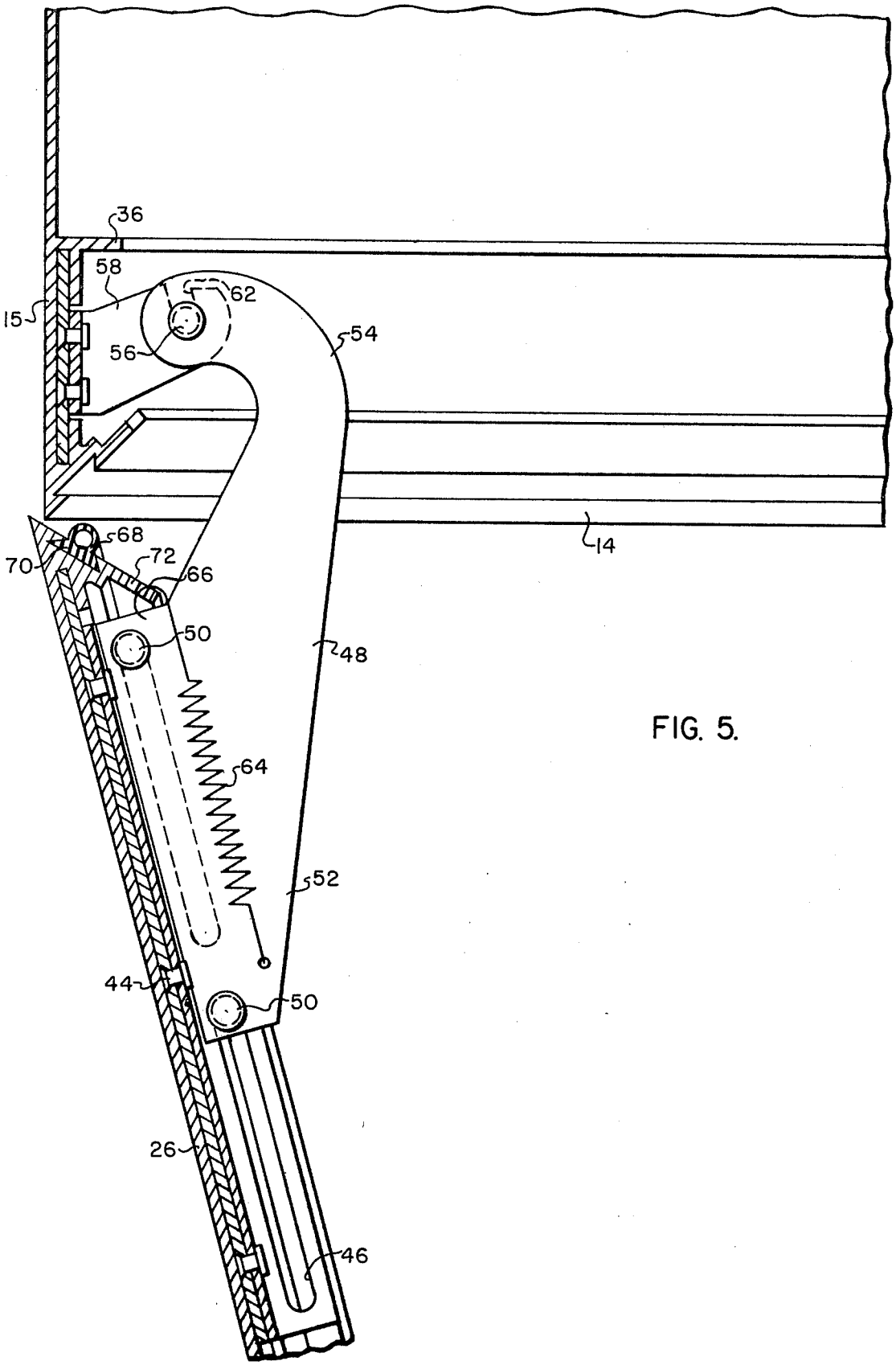
FIG. 5 is a sectional view similar to FIG. 4 illustrating the door in its full open position.

When the latches 30 are opened, and the right hand edge of the door (as seen in FIG. 2) is permitted to drop, the spring 64 will cause the door frame 26 to move away from the front end 15 of the housing since the hinge pin 56 is still retained in the slot 62 of the hinge hook 58. As best seen in FIG. 5 as the door swings downwardly, the relationship between the door and the base end 52 of the hinge arm changes as the shoulder rivets 50 move across to the other end of the elongated slots 46 in the hinge slide 40. This movement permits the end edge of the door frame 72 to swing clear beneath the bottom edge of the front end wall 15 of the luminaire housing.

Figure 6:
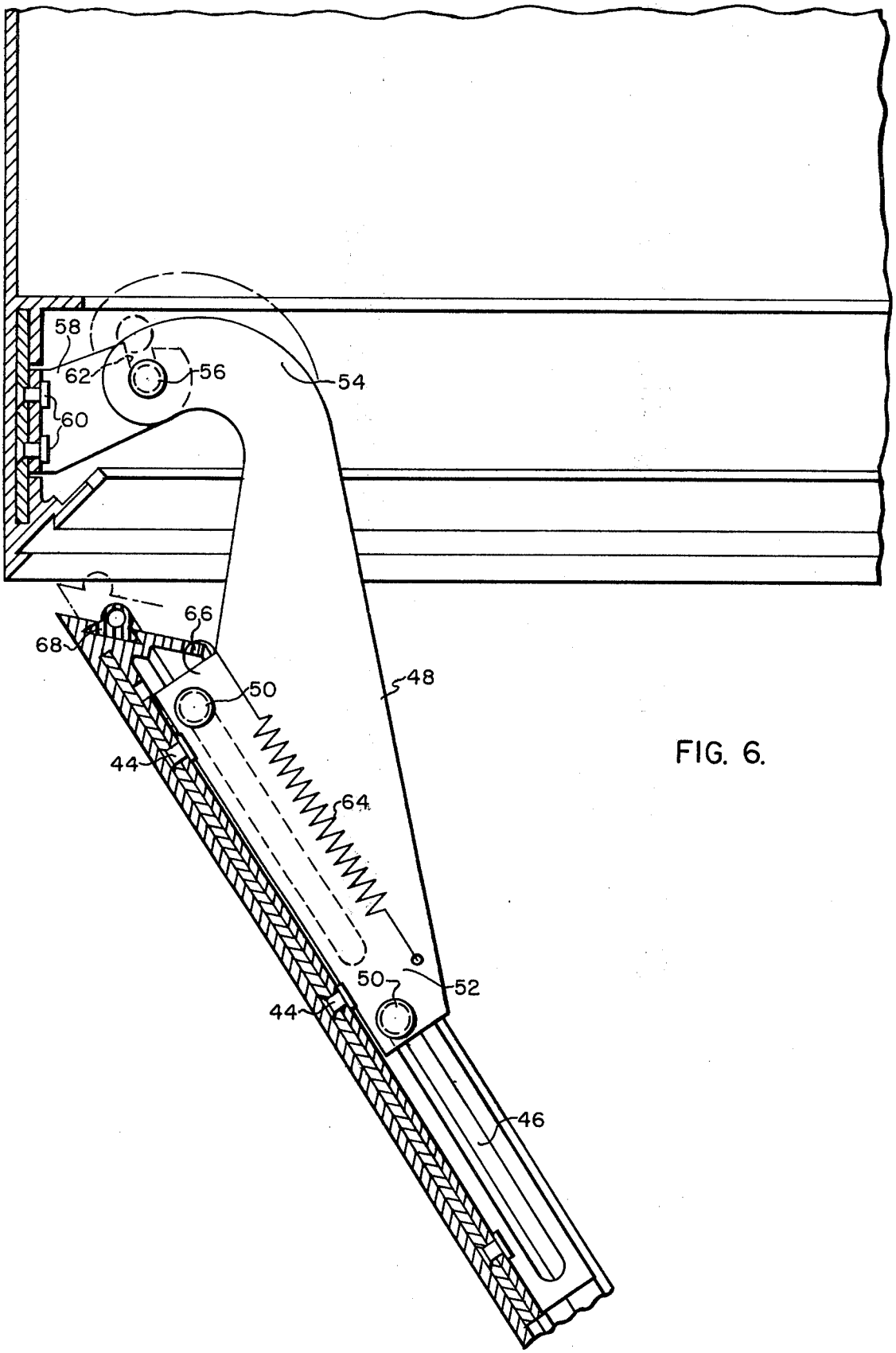
FIG. 6 is a sectional view similar to FIGS. 4 and 5 illustrating the door in a position to be removed from the housing.

Referring now to FIG. 6, it will be seen that if it is desired to remove the door 24 from the luminaire housing entirely, in the position illustrated in FIG. 6, the hinge pin 56 can be moved up and out of the slot 62 in the hinge hook 58, thus permitting the door to be completely disconnected from the luminaire housing.

When it is desired to remount the door, the door is placed in a position with respect to the housing as illustrated in FIG. 6, and the hinge pin 56 reinserted in the slot 62. This operation is facilitated by the fact that the hinge spring maintains the hinge arm in the position nearest the adjacent end of the door frame (i.e. the furthest left position as seen in the drawings). The door is then swung about the hinge pins until it reaches an almost closed position at which point it is forced to the left against the action of the hinge spring 64 to bring the end edge 72 of the door frame 26 into contact with the bottom edge of the front end wall 15 of the housing, thus permitting the door to snap into place with the spring-loaded slide hinge in the position illustrated in FIG. 4. The quarter turn latches are then secured and the luminaire housing is sealed by means of the gaskets 68 which extend about the entire circumference of the door frame end edge 72 in the slots 70.

As will be apparent from the foregoing, the sealed door structure employing the spring-loaded slide hinge of this invention, could be employed in a rectangular interior fluorescent luminiare without departing from the principles herein disclosed.

What is claimed is:

1. In a luminaire including a housing having side and end walls and a light transmitting door including a door frame contiguous with said side and end walls of said housing, an improved door mounting means comprising:

a pair of spaced hinge hooks on one end wall of said housing;

hidden hinge means on said door frame adjacent each of said hinge hooks for mounting said door to said housing, said hidden hinge means including a pair of hinge slides mounted to said door frame sides, a hinge arm mounted to each of said hinge slides for relative sliding movement therebetween, spring means interconnecting each of said hinge arms to said door frame and urging said hinge arms toward said one end wall, and a pivot pin mounted to each of said hinge arms constructed and arranged to mount said hidden hinge means to said pair of spaced hinge hooks; and latch means for latching the other end of said door frame to said housing.

2. The luminaire according to claim 1 wherein each of said hinge slides include a pair of spaced elongated slots and said hinge arms are mounted to said hinge slides for said relative sliding movement in said slot.

3. The luminaire according to claim 2 wherein a pair of shoulder rivets are mounted on each of said hinge arms and extend through said spaced elongated slots to mount each of said hinge arms to said hinge slides.

4. The luminaire according to claim 1 wherein said spaced hinge hooks mounted to said one end wall include a slot therein in which said pivot pin on said hinge arms are mounted for pivotal movement therebetween.

5. In a luminaire including a luminaire housing having side walls and a light transmitting door member including a door frame mounted to said housing, the improved hinge means interconnecting said door to said housing comprising;

an elongated hinge slide mounted on each side of said door frame adjacent the hinged end thereof having at least one elongated hinge slot extending for substantially the length of said hinge slide;

a hinge arm member having a base end and a necked end;

means interconncting the base end of said hinge arm to said hinge slot for relative movement therebetween;

a hinge pin connected to the necked end of said hinge arm and extending at right angles thereto, spring means interconnecting the end of said door frame and said hinge arm, said spring means urging said hinge arm toward said end of said door frame; and hook means on the side wall of said housing for receiving said hinge pin whereby said door frame will be shifted laterally by said spring means when said door is opened to permit removal thereof.

6. The luminaire according to claim 5 wherein said means interconnecting the base end of said hinge arm to said hinge slot is a pair of shoulder rivets fixed to said hinge arm and extending through said hinge slot.

7. The luminaire according to claim 6 wherein said at least one elongated slot is a pair of spaced elongated slots with one of said shoulder rivets disposed in each of said slots.

* * * * *